US012338556B2

(12) United States Patent
Zheng et al.

(10) Patent No.: US 12,338,556 B2
(45) Date of Patent: Jun. 24, 2025

(54) HIGH-DEFINITION TRANSPARENT BLIND FABRIC AND MANUFACTURING METHOD

(71) Applicant: Guangzhou Hande New Materials Co., Ltd, Guangzhou (CN)

(72) Inventors: Ding Zheng, Guangzhou (CN); Zhenghui Xu, Guangzhou (CN); Hao Qian, Guangzhou (CN)

(73) Assignee: Guangzhou Hande New Materials Co., Ltd, Guangzhou (CN)

( * ) Notice: Subject to any disclaimer, the term of this patent is extended or adjusted under 35 U.S.C. 154(b) by 0 days.

(21) Appl. No.: 18/361,883

(22) Filed: Jul. 30, 2023

(65) Prior Publication Data

US 2025/0034763 A1 Jan. 30, 2025

(51) Int. Cl.

| | |
|---|---|
| ***D03D 15/47*** | (2021.01) |
| ***D03D 15/283*** | (2021.01) |
| ***D03D 15/54*** | (2021.01) |
| ***D06M 15/248*** | (2006.01) |
| *D06M 101/32* | (2006.01) |

(52) U.S. Cl.

CPC ..... *D03D 15/47* (2021.01); *D03D 15/283* (2021.01); *D03D 15/54* (2021.01); *D06M 15/248* (2013.01); *D06M 2101/32* (2013.01); *D10B 2331/04* (2013.01); *D10B 2401/20* (2013.01)

(58) Field of Classification Search

None

See application file for complete search history.

(56) References Cited

FOREIGN PATENT DOCUMENTS

| | | | | |
|---|---|---|---|---|
| CN | 213013644 U | | 4/2021 | |
| CN | 217170078 U | | 8/2022 | |
| CN | 218128033 U | | 12/2022 | |
| CN | 115748062 A | | 3/2023 | |
| WO | WO-2017071199 A1 | * | 5/2017 | ..... D01F 1/04 |
| WO | WO-2019190233 A1 | * | 10/2019 | ..... B22F 3/1055 |

* cited by examiner

*Primary Examiner* — Farah Taufiq

(74) *Attorney, Agent, or Firm* — Nitin Kaushik

(57) ABSTRACT

The present application discloses a high-definition transparent blind fabric and a manufacturing method. The method comprises the following steps: preparing a polyester coated yarn, wherein the polyester coated yarn is prepared as follows: passing a dark color polyester fibre thread through a die head of a thread coating machine by a traction device, melting blackout PVC colloidal particles to form a coating layer to coat the dark color polyester fibre thread, preliminarily cooling the coated dark color polyester fibre thread via a cooling device, and passing the preliminarily cooled dark color polyester fibre thread through cooling water to obtain the polyester coated yarn; and carrying out weaving using the prepared polyester coated yarn as a polyester warp yarn and a polyester weft yarn to obtain the high-definition transparent blind fabric.

14 Claims, 5 Drawing Sheets

HIGH-DEFINITION TRANSPARENT BLIND FABRIC AND MANUFACTURING METHOD

TECHNICAL FIELD

The present application relates to the technical field of blind fabric production, and in particular to a high-definition transparent blind fabric and a manufacturing method.

BACKGROUND

At present, the curtain fabric is divided into cotton gauze cloth, polyester cloth, polyester-cotton blended cloth, cotton-linen blended cloth and non-woven cloth according to the material, and different types of curtain fabric are formed by combining different materials, textures, colors and patterns.

Reference can be made to the Chinese invention patent application document with publication number CN115748062A, which discloses a manufacturing method of a high-definition transparent blind fabric. The method comprises the following steps: preparing a polyester coated yarn; and carrying out weaving using the prepared polyester coated yarn as polyester warp yarn and polyester weft yarn; wherein the warp density of the weaving is 21±5%, and the weft density is 19±5%; the void fraction of the weaving is 1% to 10%; thus the high-definition transparent blind fabric is obtained by plain weaving. The polyester coated yarn is prepared as follows: passing a dark color polyester fibre thread through a die head of a thread coating machine by a traction device; melting blackout PVC colloidal particles to form a coating layer to coat the dark color polyester fibre thread; and passing the coated dark color polyester fibre thread through cooling water; thus the polyester coated yarn is obtained.

However, in preparation of the polyester coated yarn, the dark color polyester fibre thread coated with the molten PVC colloidal particle layer is directly cooled by cooling water, and the molten PVC colloidal particle layer s may be easily separated from the dark color polyester fibre thread.

SUMMARY

In order to reduce the possibility of the molten PVC colloidal particle layer being separated from the dark color polyester fibre thread, the present application provides a manufacturing method of a high-definition transparent blind fabric. The following technical solution is adopted.

A manufacturing method of a high-definition transparent blind fabric, comprises the following steps:

preparing a polyester coated yarn, wherein the polyester coated yarn is prepared as follows: passing the dark color polyester fibre thread through a die head of a thread coating machine by a traction device, melting blackout PVC colloidal particles to form a coating layer to coat the dark color polyester fibre thread, preliminarily cooling the coated dark color polyester fibre thread via a cooling device, and passing the preliminarily cooled dark color polyester fibre thread through cooling water to obtain the polyester coated yarn; and carry out plain weaving using the prepared polyester coated yarn as a polyester warp yarn and a polyester weft yarn to obtain the high-definition transparent blind fabric.

Preferably, the cooling device comprises a frame and a cooling pipe mounted on the top of the frame, and the dark color polyester fibre thread passes through the cooling pipe; the cooling pipe is provided with a cooling mechanism for cooling.

Preferably, the cooling mechanism comprises an ice water inlet pipe and an ice water outlet pipe; an annular cavity for ice water to pass through is provided in the cooling pipe, one ends of the ice water inlet pipe and the ice water outlet pipe are respectively in communication with two ends of the annular cavity, and one end of the ice water inlet pipe away from the cooling pipe is in communication with an ice water source.

Preferably, both ends of the cooling pipe are respectively installed with blocking devices.

Preferably, the end of the cooling pipe is provided with a mounting groove, the mounting groove is in communication with an inner cavity of the cooling pipe, and the blocking device comprises two first baffles slidingly connected to the mounting groove in a horizontal direction towards or away from each other, and a first drive assembly mounted in the mounting groove and used for driving the two first baffles to move.

Preferably, the first drive assembly comprises a double threaded lead screw rotatably connected to an inner wall of the mounting groove, and the two first baffles are respectively threadedly connected to two ends of the double threaded lead screw; one end of the double threaded lead screw passes through a side wall of the mounting groove and a hand wheel is mounted.

Preferably, two second baffles are slidingly connected to the mounting groove in a vertical direction towards or away from each other, and a second drive assembly for driving the two second baffles to move is mounted in the mounting groove.

Preferably, the second drive assembly comprises a plurality of first drive plates mounted on mutually remote sides of the two first baffles and a plurality of second drive plates mounted on mutually remote sides of the two second baffles; the plurality of first drive plates are arranged in one-to-one correspondence with the plurality of second drive plates, and a side of the first drive plate close to the second drive plate is provided with a first inclined plane, a side of the second drive plate close to the first drive plate is provided with a second inclined plane, and the plurality of first inclined planes are arranged in one-to-one correspondence with and match with the plurality of second inclined planes; drive springs are mounted on the mutually remote sides of the two second baffles, and one end of the drive spring away from the second baffle is fixedly connected to the side wall of the mounting groove.

Preferably, a connecting rod is fixedly connected to one side of each of the two first baffles, guide wheels are respectively mounted on the two connecting rods, the two guide wheels are oppositely arranged, and the dark color polyester fibre thread passes between the two guide wheels.

Preferably, the guide wheel comprises a wheel body and a mounting seat; the wheel body is rotatably mounted on the mounting seat, one end of the connecting rod away from the first baffle is provided with a first sliding groove, and the mounting seat is slidably connected to the first sliding groove; one end of the mounting seat away from the wheel body is fixedly connected to a limiting plate, and a side wall of the first sliding groove is provided with a second sliding groove for sliding of the limiting plate; a wear-reducing spring is fixedly connected to one side of the limiting plate away from the mounting seat, and one end of the wear-reducing spring away from the limiting plate is fixedly connected to the bottom of the first sliding groove.

Preferably, a viewing window is provided on a side wall of the cooling pipe corresponding to the guide wheel, a mounting frame is detachably connected to the viewing window; and a transparent plate is mounted in the mounting frame.

Preferably, a cleaning mechanism for cleaning the transparent plate is mounted on an inner wall of the cooling pipe, and the cleaning mechanism comprises a cleaning handle slidably connected to the inner wall of the cooling pipe and a brush fixedly connected to one side of the cleaning handle close to the transparent plate, wherein the brush abuts against the transparent plate; a third drive assembly is mounted within the cooling pipe for driving the cleaning handle to move.

Preferably, the third drive assembly comprises a link lever hinged to the connecting rod, one end of the link lever away from the connecting rod is hinged to the cleaning handle, two sides of the transparent plate are respectively fixedly connected to guide rods on the inner wall of the cooling pipe, and two ends of the cleaning handle are respectively slidably connected to the two guide rods.

Preferably, the frame comprises a horizontal plate and two vertical plates respectively mounted at two ends of the bottom of the horizontal plate; two ends of the bottom of the cooling pipe are respectively fixedly connected with a movable plate, the top of each of the two vertical plates is provided with a third sliding groove, the two movable plates are respectively connected to the two third sliding grooves in a vertical sliding manner, and a fourth drive assembly for driving the two movable plates to move is mounted on the frame.

The present application further provides a high-definition transparent blind fabric, comprising a polyester warp yarn, and a polyester weft yarn interwoven with the polyester warp yarn, wherein the polyester warp yarn and the polyester weft yarn both consist of a polyester coated yarn, wherein the polyester coated yarn comprises a dark color polyester fibre thread and a PVC coating layer coating the dark color polyester fibre thread.

In summary, the present application has the following beneficial effects.

1. The dark color polyester fibre thread coated with the blackout PVC material is preliminarily cooled by a cooling device, and when the dark color polyester fibre thread passes through the cooling water, the possibility that the molten PVC colloidal particle layer separates from the dark color polyester fibre thread can be reduced;

2. When it is necessary to cool the cooling pipe, ice water is injected into the annular cavity via the ice water inlet pipe, and then the ice water flows out from the ice water outlet pipe, so that the ice water can flow up, thus facilitating cooling of the cooling pipe; a cooling mechanism is provided to facilitate cooling of the cooling pipe;

3. The blocking device is provided so as to block the openings at both ends of the cooling pipe, thereby reducing heat exchange.

Figure 1:
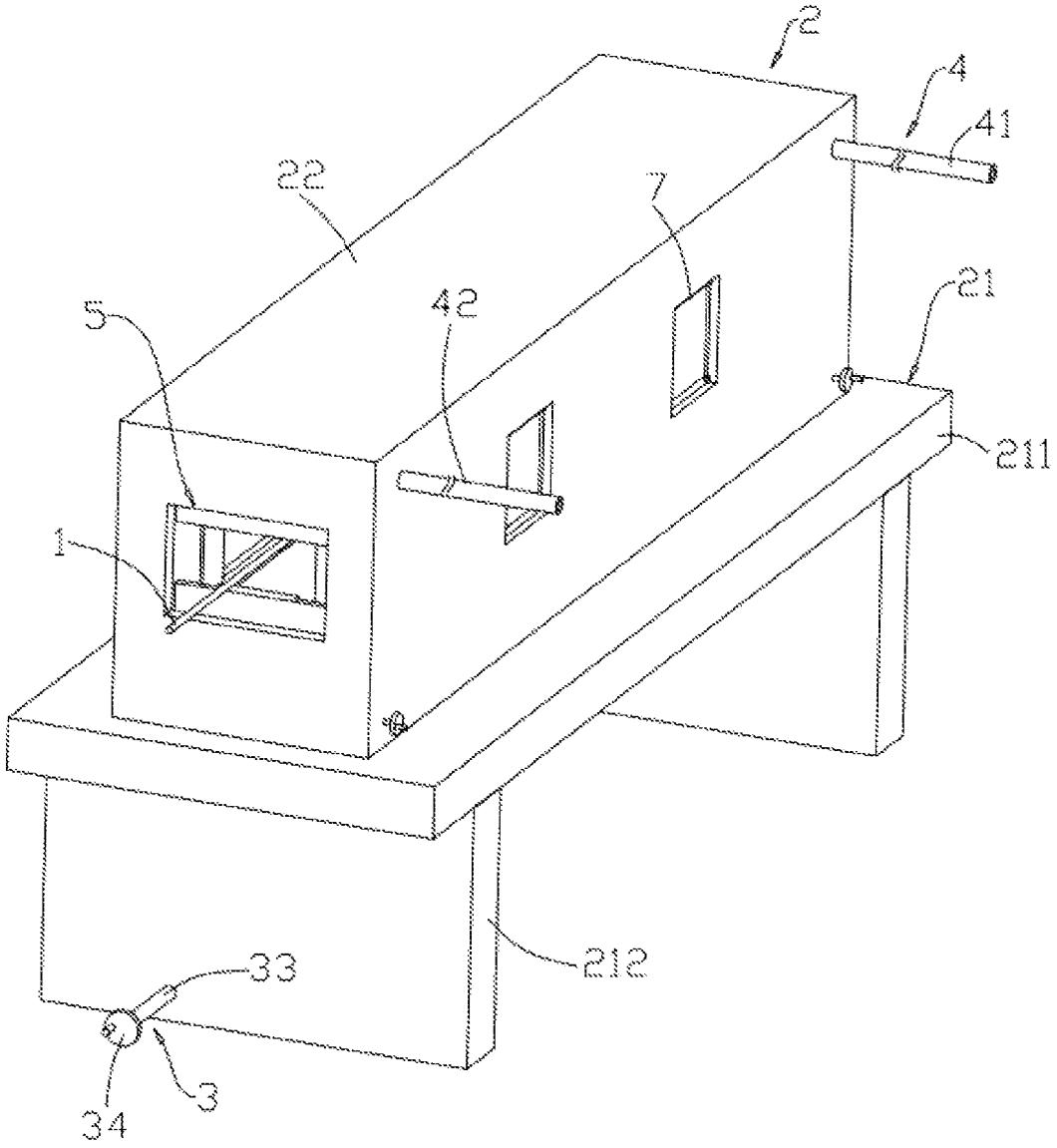
FIG. 1 is a schematic diagram of the overall structure of an embodiment of the present application.

Reference Numerals: 1, dark color polyester fibre thread; 2, cooling device; 21, frame; 211, horizontal plate; 212, vertical plate; 213, third sliding groove; 22, cooling pipe; 221, movable plate; 222, mounting groove; 3, fourth drive assembly; 31, vertical lead screw; 32, moving block; 33, horizontal shaft; 34, rotating part; 35, worm; 36, worm gear; 4, cooling mechanism; 41, ice water inlet pipe; 42, ice water outlet pipe; 43, annular cavity; 5, blocking device; 51, first baffle; 52, double threaded lead screw; 53, hand wheel; 54, second baffle; 55, first drive plate; 56, second drive plate; 57, first inclined plane; 58, drive spring; 59, second inclined plane; 6, connecting rod; 61, guide wheel; 611, wheel body; 612, mounting seat; 62, first sliding groove; 63, limiting plate; 64, second sliding groove; 65, wear-reducing spring; 7, viewing window; 71, mounting frame; 72, transparent plate; 8, cleaning mechanism; 81, cleaning handle; 82, brush; 83, link lever; and 84, guide rod.

DETAILED DESCRIPTION OF THE EMBODIMENTS

The present application is described in further detail below with reference to the accompanying drawings. Like parts are denoted by like reference numerals. It should be noted that the terms "front", "back", "left", "right", "upper", "lower", "bottom", and "top" as used in the following description refer to directions in the drawings, and the terms "inner" and "outer" refer to directions toward and away from, respectively, the geometric center of a particular component.

Embodiment

The present application discloses a high-definition transparent blind fabric and a manufacturing method, as shown in FIG. 1. The method comprises the following steps: preparing a polyester coated yarn, wherein the polyester coated yarn is prepared as follows: passing a dark color polyester fibre thread 1 through a die head of a thread coating machine by a traction device, melting blackout PVC colloidal particles to form a coating layer to coat the dark color polyester fibre thread 1, preliminarily cooling the coated dark color polyester fibre thread 1 via a cooling device 2, and passing the preliminarily cooled dark color polyester fibre thread 1 through cooling water to obtain a polyester coated yarn; and carrying out weaving using the prepared polyester coated yarn as a polyester warp yarn and a polyester weft yarn; the polyester warp yarn and polyester weft yarn are both polyester coated yarns, only the arrangement angles of the two yarns are different, and the high-definition transparent blind fabric is obtained by plain weaving.

Figure 2:
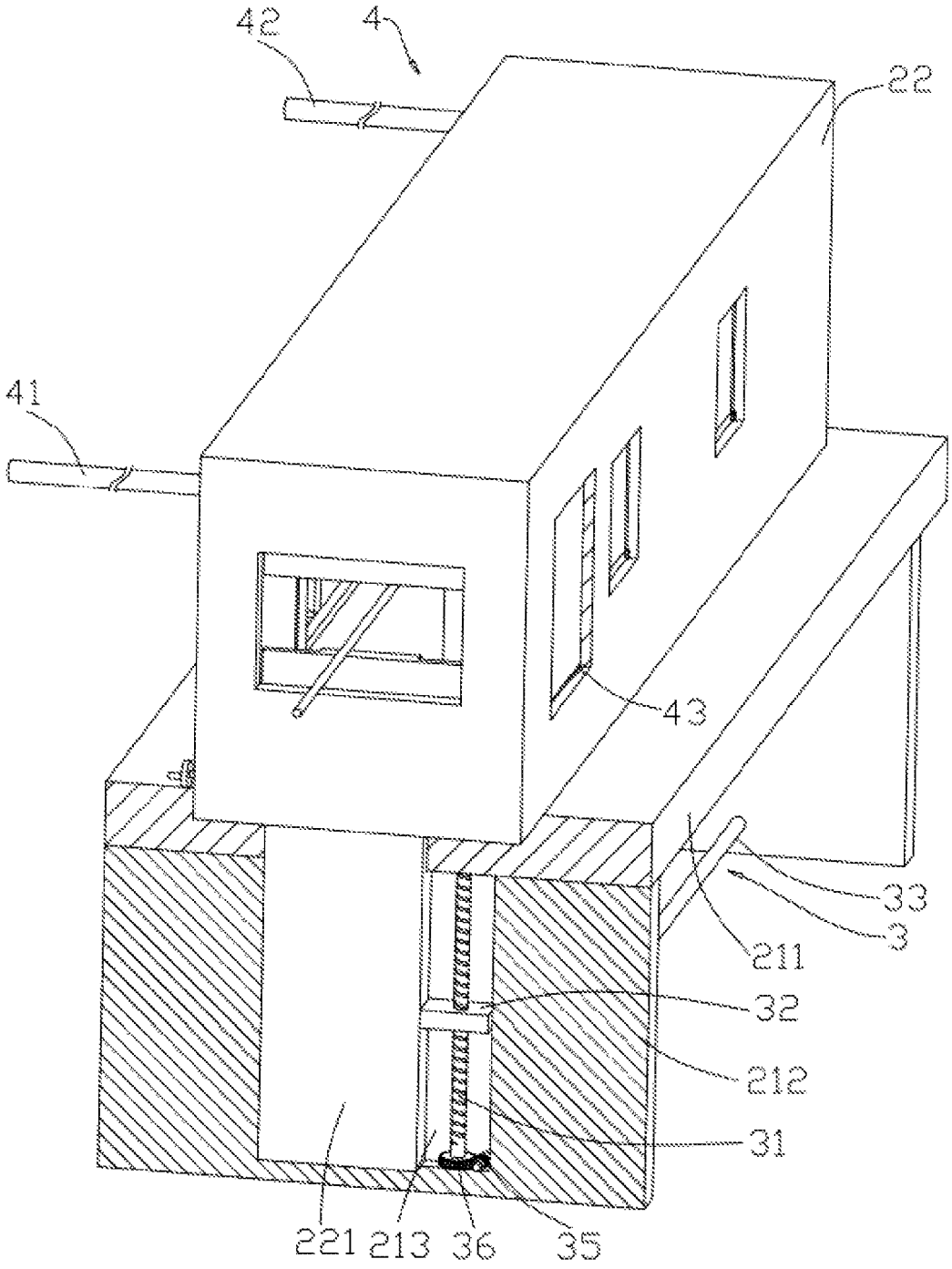
FIG. 2 is a cross-sectional view showing a fourth drive assembly and a cooling mechanism in the embodiment of the present application.

As shown in FIGS. 1 and 2, the cooling device 2 comprises a machine frame 21 and a cooling pipe 22 mounted on the top of the machine frame 21, through which the dark color polyester fibre thread 1 passes; the cooling pipe 22 is provided with a cooling mechanism 4 for cooling the cooling pipe 22. The cooling pipe 22 is provided, and when the dark color polyester fibre thread 1 coated with a blackout PVC material passes through the cooling pipe 22, the dark color polyester fibre thread 1 coated with the blackout PVC material can be preliminarily cooled; the cooling mechanism 4 is provided to facilitate cooling of the cooling pipe 22.

As shown in FIGS. 1 and 2, the frame 21 comprises a horizontal plate 211 and two vertical plates 212 respectively mounted at two ends of the bottom of the horizontal plate 211; each of the two ends of the bottom of the cooling pipe 22 is fixedly connected with a movable plate 221, the top of each of the two vertical plates 212 is provided with a third sliding groove 213, the two movable plates 221 both vertically and downwardly pass through the horizontal plate 211 and are respectively slidably connected to the two third sliding grooves 213 along the vertical direction, and the frame 21 is mounted with a fourth drive assembly 3 for driving the two movable plates 221 to move. The fourth drive assembly 3 is provided to facilitate adjustment of the height of the movable plate 221 and thus the height of the cooling pipe 22, which facilitates the use of the cooling device 2 in conjunction with a traction device.

As shown in FIGS. 1 and 2, the fourth drive assembly 3 comprises two vertical lead screws 31 respectively connected to the two third sliding grooves 213 by means of vertical rotation via bearings, a moving block 32 is fixedly connected to one side of the two movable plates 221, and the two moving blocks 32 are respectively threadedly connected to the two vertical lead screws 31; a horizontal shaft 33 is rotatably connected to the two vertical plates 212, and a rotating part 34 is mounted on one end of the horizontal shaft 33; two worms 35 are mounted on the horizontal shaft 33, and a worm gear 36 is mounted on each of two vertical lead screws 31, and the two worms 35 are engaged with the two worm gears 36, respectively. When the height of the movable plate 221 needs to be adjusted, the horizontal shaft 33 is firstly driven to rotate by the rotating part 34, the horizontal shaft 33 rotates to drive the worm 35 to rotate, the worm 35 rotates to drive the worm wheel 36 to rotate, the worm wheel 36 rotates to drive the vertical lead screw 31 to rotate, and the vertical lead screw 31 rotates to drive the movable plate 221 to move. The fourth drive assembly 3 is provided to facilitate the movement of the movable plate 221.

As shown in FIGS. 1 and 2, the cooling mechanism 4 comprises an ice water inlet pipe 41 and an ice water outlet pipe 42; the cooling pipe 22 is provided with an annular cavity 43 for ice water to pass through, one ends of the ice water inlet pipe 41 and the ice water outlet pipe 42 are respectively in communication with two ends of the annular cavity 43, one end of the ice water inlet pipe 41 away from the cooling pipe 22 is in communication with an ice water source, and one end of the ice water outlet pipe 42 away from the cooling pipe 22 extends to an ice water treatment position. When it is necessary to cool the cooling pipe 22, ice water is injected into the annular cavity 43 via the ice water inlet pipe 41, and then the ice water flows out from the ice water outlet pipe 42, so that the ice water is enabled to flow; thus facilitating cooling of the cooling pipe 22. The cooling mechanism 4 is provided to facilitate cooling of the cooling pipe 22.

Figure 3:
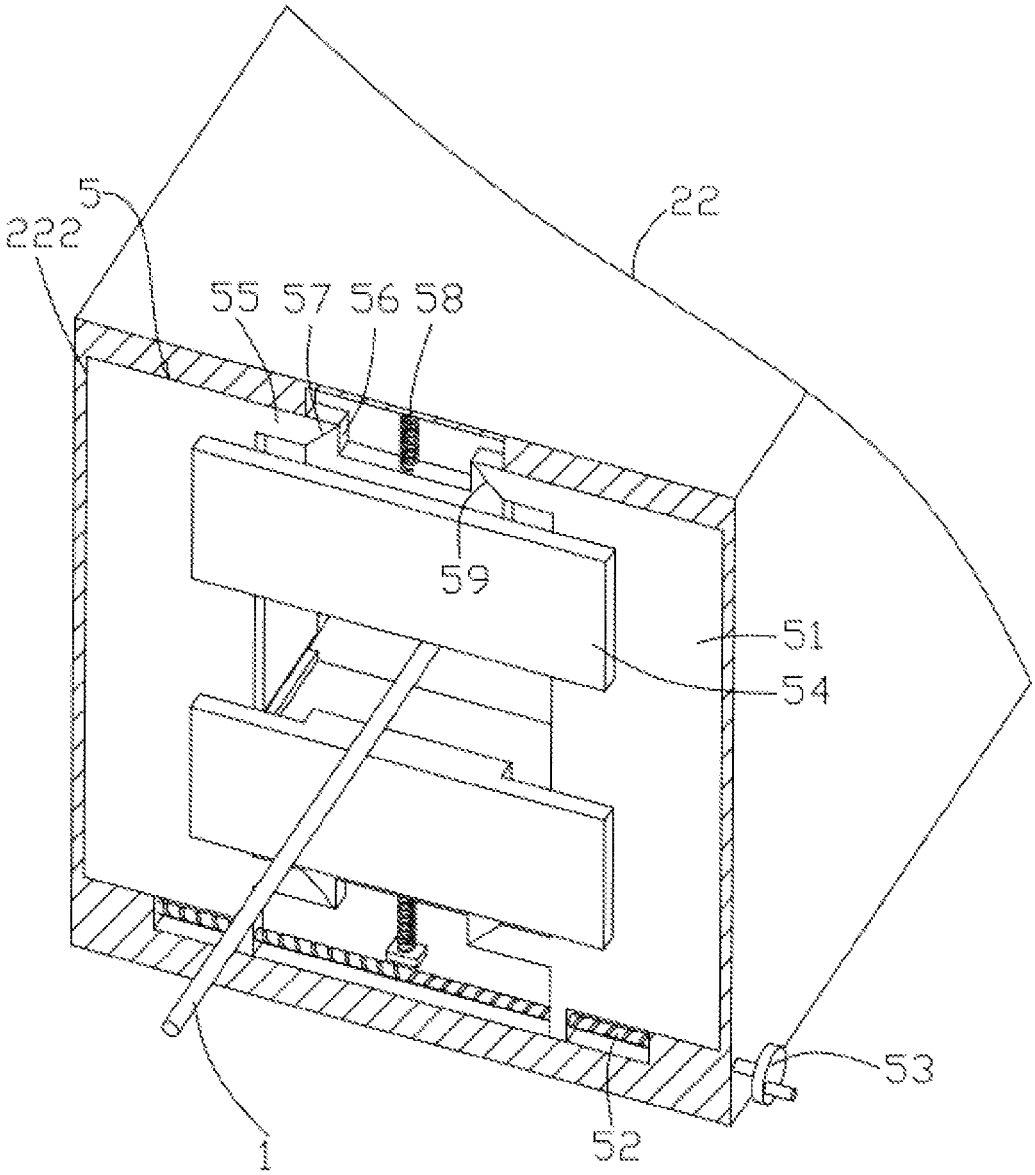
FIG. 3 shows a cross-sectional view of a blocking device in the embodiment of the present application.

As shown in FIGS. 1 and 3, each of the two ends of the cooling pipe 22 is mounted with a blocking device 5, the end of the cooling pipe 22 is provided with a mounting groove 222, the mounting groove 222 is in communication with the inner cavity of the cooling pipe 22, the blocking device 5 comprises two first baffles 51 slidingly connected to the mounting groove 222 along the width direction of the horizontal plate 211 toward each other or away from each other, and a first driving assembly mounted on the mounting groove 222 for driving the two first baffles 51 to move; a vacuum chamber is provided in the first baffle 51. By driving the two first baffles 51 to move toward each other by the first driving assembly, the opening of the cooling pipe 22 can be made small, so that heat exchange can be reduced.

As shown in FIG. 3, the first drive assembly comprises a double threaded lead screw 52 rotatably connected to the inner wall of the mounting groove 222 via a bearing, the double threaded lead screw 52 is arranged along the width direction of the horizontal plate 211, and the two first baffles 51 are respectively threadedly connected to two ends of the double threaded lead screw 52; one end of the double threaded lead screw 52 passes through a side wall of the mounting groove 222 and a hand wheel is mounted. When it is required to drive the two first baffles 51 to move towards or away from each other, firstly the double threaded lead screw 52 are driven to rotate by the hand wheel, and the double threaded lead screw 52 rotates to drive the two first baffles 51 to move towards or away from each other. The first drive assembly is provided to drive the two first baffles 51 towards or away from each other.

As shown in FIG. 3, two second baffles 54 are slidably connected to the mounting groove 222 in a vertical direction towards or away from each other, and a second drive assembly for driving the two second baffles 54 to move is mounted in the mounting groove 222; a vacuum chamber is provided in the second baffle 54. By driving the two second baffles 54 towards each other by the second drive assembly, the opening of the cooling pipe 22 can be further made smaller, so that the heat exchange can be further reduced.

As shown in FIG. 3, the second drive assembly comprises a plurality of first drive plates 55 mounted on mutually remote sides of the two first baffles 51 and a plurality of second drive plates 56 mounted on mutually remote sides of the two second baffles 54; the plurality of first drive plates 55 are arranged in one-to-one correspondence with the plurality of second drive plates 56, and a side of the first drive plate 55 close to the second drive plate 56 is provided with a first inclined plane 57, a side of the second drive plate 56 close to the first drive plate 55 is provided with a second inclined plane 59, and the plurality of first inclined planes 57 are arranged in one-to-one correspondence with and match with the plurality of second inclined planes 59; drive springs 58 are respectively mounted on the mutually remote sides of the two second baffles 54, the drive spring 58 is vertically arranged, and one end of the drive spring 58 away from the second baffle 54 is fixedly connected to the side wall of the mounting groove 222. When the two first baffles 51 move towards each other, the first drive plate 55 is driven to move, at this moment, the first drive plate 55 drives the second drive plate 56 to move under the action of the first inclined plane 57 and the second inclined plane 59, and the second drive plate 56 moves to enable the two second baffles 54 to move towards each other. When it is required to move the two second baffles 54 away from each other, first the two first baffles 51 are moved away from each other by the first drive assembly, and then the two second baffles 54 can move away from each other under the action of the two drive springs 58. The second drive assembly is provided to facilitate movement of the two second baffles 54 toward and away from each other.

Figure 4:
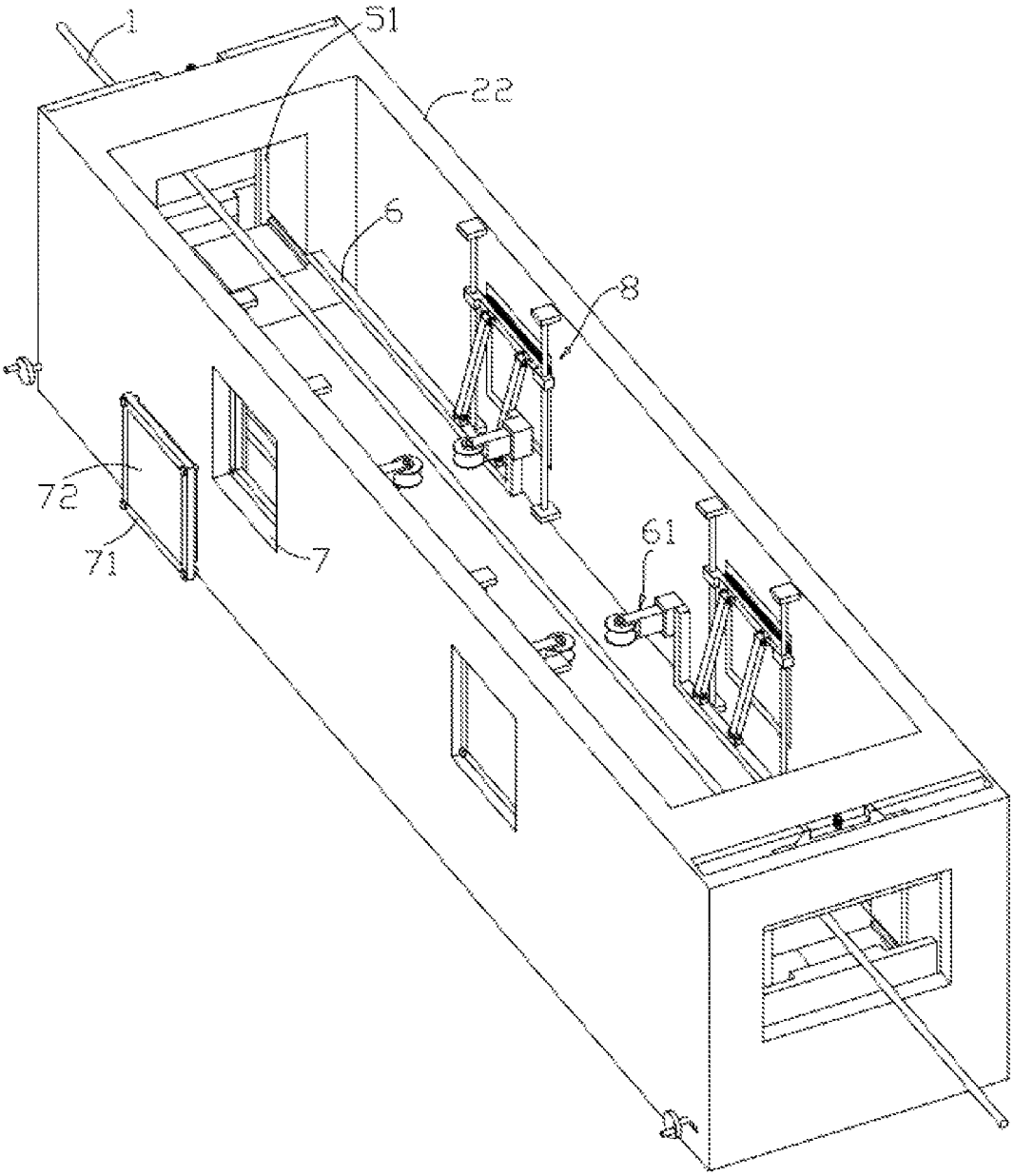
FIG. 4 is a schematic diagram showing the structure of a cleaning mechanism in the embodiment of the present application.

As shown in FIG. 4, a connecting rods 6 is fixedly connected to one side of each of the two first baffles 51, the connecting rods 6 extend in the axial direction of the cooling pipe 22, guide wheels 61 are respectively mounted on the two connecting rods 6, the two guide wheels 61 are oppositely arranged, and the dark color polyester fibre thread 1 passes between the two guide wheels 61. The guide wheels 61 are provided to facilitate guiding of the dark color polyester fibre thread 1; the connecting rod 6 is arranged to adjust the distance between the two guide wheels 61 when the distance between the two first baffles 51 is adjusted, thereby facilitating the passage of the dark color polyester fibre threads 1 of different thicknesses between the two guide wheels 61.

Figure 5:
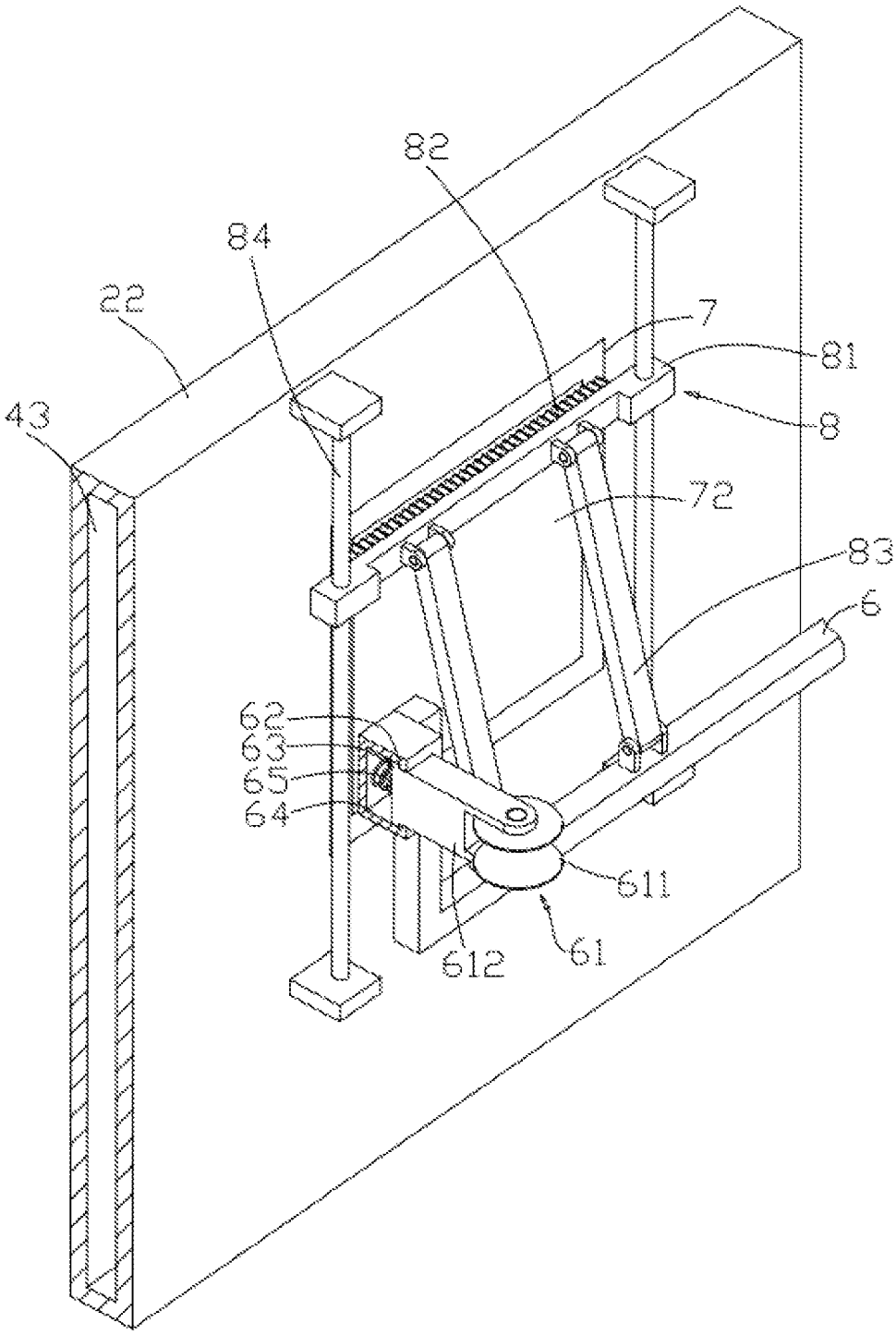
FIG. 5 is a schematic diagram showing a structure in which a guide wheel is connected to a connecting rod in the embodiment of the present application.

As shown in FIGS. 4 and 5, the guide wheel 61 comprises a wheel body 611 and a mounting seat 612; the wheel body 611 is rotatably mounted on the mounting seat 612, one end of the connecting rod 6 away from the first baffle 51 is provided with a first sliding groove 62, and the mounting seat 612 is slidably connected to the first sliding groove 62 along the width direction of the horizontal plate 211; one end of the mounting seat 612 away from the wheel body 611 is fixedly connected to a limiting plate 63, and a side wall of the first sliding groove 62 is provided with a second sliding groove 64 for the limiting plate 63 to slide along the width direction of the horizontal plate 211; a wear-reducing spring 65 is fixedly connected to one side of the limiting plate 63 away from the mounting seat 612, the wear-reducing spring 65 is arranged along the width direction of the horizontal plate 211, and one end of the wear-reducing spring 65 away from the limiting plate 63 is fixedly connected to the bottom of the first sliding groove 62. The first sliding groove 62 is provided to facilitate the movement of the mounting seat 612; when the friction between the dark color polyester fibre thread 1 and the wheel body 611 is large, the wear-reducing spring 65 can move the mounting seat 612 away from the dark color polyester fibre thread 1, thereby reducing the wear of the dark color polyester fibre thread 1.

As shown in FIG. 4, a viewing window 7 is provided on the side wall of the cooling pipe 22 corresponding to the guide wheel 61, a mounting frame 71 is detachably connected to the viewing window 7 via a bolt, and a transparent plate 72 is mounted in the mounting frame 71. The viewing window 7 is provided to allow observation to the inside of the cooling pipe 22.

As shown in FIGS. 3 and 4, a cleaning mechanism 8 for cleaning the transparent plate 72 is mounted on the inner wall of the cooling pipe 22, and the cleaning mechanism 8 comprises a cleaning handle 81 vertically slidably connected to the inner wall of the cooling pipe 22 and a brush 82 fixedly connected to one side of the cleaning handle 81 close to the transparent plate 72, and the brush 82 abuts against the transparent plate 72; a third drive assembly for driving the cleaning handle 81 to move is mounted within the cooling pipe 22. When it is necessary to clean the transparent plate 72, first the cleaning handle 81 is driven to move by the third driving assembly, the movement of the cleaning handle 81 driving the movement of the cleaning brush, and the movement of the cleaning brush enables cleaning of the transparent plate 72. The cleaning mechanism 8 is provided to facilitate cleaning of the transparent plate 72.

As shown in FIG. 4, the third drive assembly comprises two link levers 83 hinged to the connecting rod 6, one end of the two link lever 83 away from the connecting rod 6 is hinged to the cleaning handle 81, guide rods 84 are respectively fixedly connected to the inner wall of the cooling pipe 22 at two sides of the transparent plate 72, the two guide rods 84 respectively pass through two ends of the cleaning handle 81, and the two ends of the cleaning handle 81 are respectively connected to the two guide rods 84 in a vertical sliding manner. The connecting rod 6 moves in a direction away from the dark color polyester fibre thread 1 to drive the movement of the link lever 83, and the movement of the link lever 83 drives the movement of the cleaning handle 81. The third drive assembly is provided to facilitate movement of the cleaning handle 81.

Working principle: the dark color polyester fibre thread 1 coated with the blackout PVC material is preliminarily cooled by the cooling pipe 22, and when the dark color polyester fibre thread 1 passes through the cooling water, the possibility that the molten PVC colloidal particle layer separates from the dark color polyester fibre thread 1 can be reduced.

In addition, the present application provides a high-definition transparent blind fabric, comprising a polyester warp yarn and a polyester weft yarn interwoven with the polyester warp yarn, wherein the polyester warp yarn and the polyester weft yarn both consist of a polyester coated yarn, and the polyester coated yarn comprises a dark color polyester fibre thread 1 and a PVC coating layer coating the dark color polyester fibre thread 1.

The above are preferred embodiments of the present application, and the scope of protection of the present application is not limited thereto, so equivalent changes in structure, shape and principle of the present application shall be covered by the protection scope of the present application.

What is claimed is:

1. A manufacturing method of a transparent blind fabric, comprising the following steps:

preparing a polyester coated yarn, wherein the polyester coated yarn is prepared as follows:

passing a dark color polyester fibre thread through a die head of a thread coating machine by a traction device, melting blackout PVC colloidal particles to form a coating layer to coat the dark color polyester fibre thread, preliminarily cooling the coated dark color polyester fibre thread via a cooling device, and passing the preliminarily cooled dark color polyester fibre thread through cooling water to obtain the polyester coated yarn; and carrying out plain weaving using the prepared polyester coated yarn as a polyester warp yarn and a polyester weft yarn to obtain the transparent blind fabric.

2. The manufacturing method of a transparent blind fabric of claim 1, wherein the cooling device comprises a frame and a cooling pipe mounted on the top of the frame, and the dark color polyester fibre thread passes through the cooling pipe; the cooling pipe is provided with a cooling mechanism for cooling.

3. The manufacturing method of a transparent blind fabric of claim 2, wherein the cooling mechanism comprises an ice water inlet pipe and an ice water outlet pipe; an annular cavity for ice water to pass through is provided in the cooling pipe, one ends of the ice water inlet pipe and the ice water outlet pipe are respectively in communication with two ends of the annular cavity, and one end of the ice water inlet pipe away from the cooling pipe is in communication with an ice water source.

4. The manufacturing method of a transparent blind fabric of claim 2, wherein both ends of the cooling pipe are respectively installed with blocking devices.

5. The manufacturing method of a transparent blind fabric of claim 4, wherein the end of the cooling pipe is provided with a mounting groove, the mounting groove is in communication with an inner cavity of the cooling pipe, and the blocking device comprises two first baffles slidingly connected to the mounting groove in a horizontal direction towards or away from each other, a first drive assembly mounted in the mounting groove and used for driving the two first baffles to move, and a second set of baffles referred to as two second baffles.

6. The manufacturing method of a transparent blind fabric of claim 5, wherein the first drive assembly comprises a double threaded lead screw rotatably connected to an inner wall of the mounting groove, and the two first baffles are respectively threadedly connected to two ends of the double threaded lead screw; one end of the double threaded lead screw passes through a side wall of the mounting groove and a hand wheel is mounted.

7. The manufacturing method of a transparent blind fabric of claim 5, wherein the two second baffles, are slidingly connected to the mounting groove in a vertical direction towards or away from each other, and a second drive assembly for driving the two second baffles to move is mounted in the mounting groove.

8. The manufacturing method of a transparent blind fabric of claim 7, wherein the second drive assembly comprises a plurality of first drive plates mounted on mutually remote sides of the two first baffles and a plurality of second drive plates mounted on mutually remote sides of the two second baffles; the plurality of first drive plates are arranged in one-to-one correspondence with the plurality of second drive plates, and a side of the first drive plate close to the second drive plate is provided with a first inclined plane, a side of the second drive plate close to the first drive plate is provided with a second inclined plane, and the plurality of first inclined planes are arranged in one-to-one correspondence with and match with the plurality of second inclined planes; drive springs are mounted on the mutually remote sides of the two second baffles, and one end of the drive spring away from the second baffle is fixedly connected to the side wall of the mounting groove.

9. The manufacturing method of a transparent blind fabric of claim 7, wherein a connecting rod is fixedly connected to one side of each of the two first baffles, guide wheels are respectively mounted on the two connecting rods, the two guide wheels are oppositely arranged, and the dark color polyester fibre thread passes between the two guide wheels.

10. The manufacturing method of a transparent blind fabric of claim 9, wherein the guide wheel comprises a wheel body and a mounting seat; the wheel body is rotatably mounted on the mounting seat, one end of the connecting rod away from the first baffle is provided with a first sliding groove, and the mounting seat is slidably connected to the first sliding groove; one end of the mounting seat away from the wheel body is fixedly connected to a limiting plate, and a side wall of the first sliding groove is provided with a second sliding groove for sliding of the limiting plate; a wear-reducing spring is fixedly connected to one side of the limiting plate away from the mounting seat, and one end of the wear-reducing spring away from the limiting plate is fixedly connected to the bottom of the first sliding groove.

11. The manufacturing method of a transparent blind fabric of claim 9, wherein a viewing window is provided on a side wall of the cooling pipe corresponding to the guide wheel, a mounting frame is detachably connected to the viewing window, and a transparent plate is mounted in the mounting frame.

12. The manufacturing method of a transparent blind fabric of claim 11, wherein a cleaning mechanism for cleaning the transparent plate is mounted on an inner wall of the cooling pipe, and the cleaning mechanism comprises a cleaning handle slidably connected to the inner wall of the cooling pipe and a brush fixedly connected to one side of the cleaning handle close to the transparent plate, wherein the brush abuts against the transparent plate; a third drive assembly is mounted within the cooling pipe for driving the cleaning handle to move.

13. The manufacturing method of a transparent blind fabric of claim 12, wherein the third drive assembly comprises a link lever hinged to the connecting rod, one end of the link lever away from the connecting rod is hinged to the cleaning handle, two sides of the transparent plate are respectively fixedly connected to guide rods on the inner wall of the cooling pipe, and two ends of the cleaning handle are respectively slidably connected to the two guide rods.

14. The manufacturing method of a transparent blind fabric of claim 2, wherein the frame comprises a horizontal plate and two vertical plates respectively mounted at two ends of the bottom of the horizontal plate; two ends of the bottom of the cooling pipe are respectively fixedly connected with a movable plate, the top of each of the two vertical plates is provided with a third sliding groove, the two movable plates are respectively connected to the two third sliding grooves in a vertical sliding manner, and a fourth drive assembly for driving the two movable plates to move is mounted on the frame.

* * * * *